United States Patent [19]

Leach

[11] Patent Number: 4,752,297

[45] Date of Patent: Jun. 21, 1988

[54] PROCESS FOR COLORING WOOD WITH IRON SALT IN WATER

[75] Inventor: Robert M. Leach, Grand Island, N.Y.

[73] Assignee: Osmose Wood Preserving, Inc., Buffalo, N.Y.

[21] Appl. No.: 19,041

[22] Filed: Feb. 26, 1987

[51] Int. Cl.[4] ..... D06P 3/60

[52] U.S. Cl. ..... 8/402; 8/623; 8/645

[58] Field of Search ..... 8/402, 645, 623

[56] References Cited

U.S. PATENT DOCUMENTS

| | | | |
|---|---|---|---|
| 3,622,380 | 11/1971 | Williams | 8/402 |
| 3,915,631 | 10/1975 | Conner | 8/623 |
| 4,313,976 | 2/1982 | Leach | 427/297 |
| 4,379,073 | 4/1983 | Zimmerman | 252/400.5 |
| 4,622,248 | 11/1986 | Leach et al. | 427/440 |

OTHER PUBLICATIONS

Hartford, W. H., American Wood Preservers' Association, 1986, pp. 1–16.

*Primary Examiner*—A. Lionel Clingman

*Attorney, Agent, or Firm*—Christel, Bean & Linihan

[57] ABSTRACT

A process for coloring wood whereby the resulting color will not change or substantially fade upon exposure to long term environmental weathering, which process comprises contacting the wood with an aqueous solution containing 0.01%–10% of an iron salt derived from a mono-, di-, or tri-carboxylic acid or a mono-, di-, or tri-carboxylic hydroxy acid containing 1–6 carbon atoms. The iron salt solution of this invention may be used to color nontreated wood as well as wood treated with known preservative compositions containing one or more heavy metals including copper, chromium, arsenic and zinc.

22 Claims, No Drawings

PROCESS FOR COLORING WOOD WITH IRON SALT IN WATER

BACKGROUND OF INVENTION

This invention relates to a process for coloring wood and other cellulose based products. More specifically, the present invention relates to a method for imparting a desired color to wood products, which color will not fade or substantially change upon exposure to long term environmental weathering.

It has long been a primary goal of the wood treating industry to produce wood products that are artistically and aesthetically acceptable to the public, yet preserved from the destructive agencies of wood. Wood that is colored and preserved is in great demand for home use, especially for use in siding, fencing and decking. Unfortunately, many of the preservative solutions used to preserve against wood destroying organisms impart their own color to the wood. In many cases, the coloration imparted by these preservative solutions is undesirable for one reason or another.

Numerous conventional processes are available for coloring and staining wood, while several processes are available to preserve wood from the various wood destroying agencies. Many of these known processes are less than desirable because they are multi-step operations. Other conventional processes provide only a surface coloration which will scratch and wear away and require additional treatment or servicing for exposure to long term weathering.

One technique currently used to color wood is to paint the wood with an oil base paint or pigmented coating. Depending on the type of preservative used, some of the coatings will not adhere to the wood, resulting in blistering or flaking in a short period of time. Conventional organic preservatives, such as creosote and pentachlorophenol, pose problems because of oily films left on the treated wood, which require several months to season and even then it is difficult to paint or stain the wood.

Water-borne preservatives are preferred over the organic products because the wood is not coated with a film and can be readily painted or stained after treatment. However, here again, the coloration is only on the surface with these techniques, resulting in limited permanence to weathering.

Alternatively, the wood may be precoated with a coloring agent, such as an oil base or latex paint, followed by treatment with the wood preservative. Many of the oil base or latex paints will form a coating on the surface of the wood which reduces or eliminates the penetration of the preservative into the wood. In many cases, the coatings and the preservatives are incompatible.

In more recent years attempts have been made to develop processes which color and preserve the wood simultaneously. One such process is disclosed in U.S. Pat. No. 4,313,976. This process consists of using a specific naphthalene or benzene derivative compound having hydroxy, amino or sulfonic acid functional groups attached to a carbon ring. One of the drawbacks associated with this system is that it will weather from its original reddish brown color to a light brownish gray color after about six to twelve months exposure to the elements.

Therefore, due to the shortcomings associated with current methods for wood treatment, the need still remains for a process whereby wood may be colored and preserved in a single or combined operation. More particularly, the need remains for an improved process wherein the wood product resulting after treatment is able to withstand long term weathering without any substantial loss of color.

SUMMARY OF THE INVENTION

In has now been discovered that wood treated with a water based solution of one or more iron salts derived from certain organic acids containing 1–6 carbon atoms will exhibit an aesthetically pleasing brown color which upon long term weathering (i.e. in excess of one year) remains brown or becomes a darker shade of brown rather than weathering to a silver gray color.

It has further been discovered that the addition of one or more iron salts derived from certain organic acids containing 1–6 carbon atoms to a water based solution of a known preservative composition containing one or more heavy metals selected from the group consisting of copper, chromium arsenic and zinc will cause the wood undergoing treatment with such a solution to exhibit a brown coloration which remains brown or becomes a deeper shade of brown even after exposure to long term weathering.

Where the preservative treating solution contains copper, chromium and/or arsenic, such as in a CCA system, iron is generally considered an unwanted contaminant responsible for precipitate or sludge formation within the treating solution. [Hartford, "The Practical Chemistry of CCA in Service", American Wood Preservers Association, pp 1–15, 1986.] Accordingly, it is totally unexpected that the addition of an iron salt to a preservative system, especially a CCA system, would provide enhanced long term coloring capability without causing a precipitate to form.

DETAILED DESCRIPTION OF THE INVENTION

The color forming and stabilizing compound in accord with this invention is an iron salt derived from a mono-, di-, or tri-carboxylic acid or mono-, di-, or tri-carboxylic hydroxy acid containing from 1–6 carbon atoms. Acceptable salts may be derived from the following acids: formic, acetic, glycolic, lactic, hydroxybutyric, glyceric, malic, tartaric, citric, oxalic, malonic, succinic, glutaric and adipic. Preferred iron salts are selected from the group consisting of ferric ammonium citrate, ferrous ammonium citrate, ferric ammonium oxalate, ferrous ammonium oxalate, ferric citrate, ferrous citrate, ferric oxalate and ferrous oxalate. Most of the above salts are available commercially through various suppliers. For example, ferric ammonium citrate and ferric ammonium oxalate which may be purchased from Pfizer, Inc. and Allied Chemical Corp., respectively. Alternatively, the salt solution may be prepared by chemical procedures which are well known in the art.

The amount of iron salt present in the aqueous salt treating solution or added to the preservative solution may vary from 0.01% by weight to 10%. A preferred concentration is 0.1%–2.0% while the most preferred concentration is 0.5%–1%.

Examples of water soluble preservative concentrate systems that can be used with the iron salts of this invention are:

1. Acid Copper Chromate: Containing about 28.0%–31.8% copper as copper oxide and about 63.3%–68.2% chromium as chromic acid.

2. Chromated Copper Arsenate (CCA) Types A, B and C: Type A containing from 16.0%–20.9% copper as copper oxide, about 59.4%–69.3% chromium as chromic acid and about 14.7%–19.7% arsenic as arsenic pentoxide; Type B containing from 18.0%–22.0% copper as copper oxide, about 33.0%–38.0% chromium as chromic acid and about 42.0%–48.0% arsenic as arsenic pentoxide; Type C containing from 17.0%–21.0% copper as copper oxide, about 44.5%–50.5% chromium as chromic acid and about 30%–38% arsenic as arsenic pentoxide.

3. Fluor-Chrome-Arsenate-Phenol: Containing about 20.0%–24.0% fluoride, about 33.0%–41.0% chromium as chromic acid, about 22.0%–28.0% arsenic as arsenic pentoxide and 14.0%–18.0% dinitrophenol.

4. Chromated Zinc Chloride: Containing about 19.0%–20.0% chromium as chromic acid and about 76.0%–80.0% zinc as zinc oxide.

5. Tanilith C: Containing about 18.9% copper as copper oxide, about 51.8% chromium as chromic acid and about 29.3% arsenic as arsenic pentoxide.

6. Copperized Chromated Zinc Arsenate: Containing about 13.0% copper as copper oxide, about 20.3% chromium as chromic acid, about 11.5% zinc as zinc oxide and about 55.2% arsenic as arsenic pentoxide.

7. Ammoniacal Copper Arsenate: Containing a minimum of 47.7% copper as copper oxide and a minimum of 47.6% arsenic as $As_2O_5$.

8. Ammoniacal Copper Zinc Arsenate: Containing about 45.0%–55.0% copper as copper oxide, about 22.5%–27.5% zinc as zinc oxide and 22.5%–27.5% arsenic as arsenic pentoxide.

9. Ammoniacal Copper Citrate: Containing about 55.7% copper as copper oxide and about 44.3% citric acid.

Most of the preservative compositions listed above are commerically available.

In prior issued U.S. Pat. No. 4,313,976, the disclosure of which is hereby incorporated by reference, it was demonstrated that by adding various naphthalene or benzene derivative compounds containing hydroxy, amino or sulfonic acid functional groups to a water soluble preservative solution, wood treated therein would exhibit a reddish-brown color. Optionally, various dyes may also be added to such a system to further strengthen and control the color imparted to the wood. It has now been discovered that when the iron salts of this invention are introduced into such combination coloring and preserving systems, there is a substantial improvement in the weathering properties of the treated wood to the point where it will maintain its dark brown color after one to two years exposure to the elements.

It has also been discovered that the color forming iron salts in accord with this invention may be used to impart color to wood treated with aqueous ammoniacal solutions of preservative metal compounds combined with certain specified organic acids. Such preservative systems are described in U.S. Pat. No. 4,622,248, the disclosure of which is likewise hereby incorporated by reference.

The iron salt color forming and stabilizing compound of this invention may be added directly to the preservative treating solution. It is also possible to first treat the wood with the preservative solution, followed by treatment with a water solution of the iron salt, either alone or in combination with other additives such as dyes and/or various naphthalene or benzene derivative compounds having hydroxy, amino or sulfonic acid functional groups. Alternatively, the aqueous iron salt solution may initially be applied to the wood, alone or in combination with other additives, followed by treatment with the preservative solution. Regardless of the application method utilized, the tan/brown color imparted to the wood remains brown or exhibits a deeper shade of brown upon weathering rather than converting to the typical green or gray color.

Temperature and pressure parameters are not critical to carrying out this invention. A fairly wide temperature range may be employed. The lower limit should be sufficiently warm to prevent the solution from freezing.

A fairly broad pH range may also be utilized, provided the pH of the combined treating solution is compatible with the preservative system employed. For instance, when the iron salt solution is added to a CCA preservative system, the pH of the final solution should be maintained between 0.5–3.0, and preferably between 1.5–2.0, by the addition of an acid such as sulfuric, phosphoric, etc.

The treating solution may be applied to the wood by dipping, soaking, brushing, etc., however, vacuum and/or pressure techniques may be used to impregnate the wood according to the method of this invention, including both the Empty Cell Process and the Full Cell Process which are well known to those skilled in the art.

The "Full Cell", or Bethell, process is employed in the creosoting of railway sleepers and marine timbers and is the normal method of treatment of any class of timber with water borne preservatives, you may be used with the treating solution of the invention. It has been in continuous use since 1838 and consists of first subjecting the timber in a cylinder to a vacuum up to 28 inches for ½ to 1 hour, then filling the cylinder with the treating solution and applying a pressure of up to 180–200 lbs. per square inch until the required amount of treating solution has been injected into the timber. The cylinder is then emptied of treating solution and the treated timber optionally subjected to a short final vacuum to clean up the surface of the timber. It is usual to heat the treating solution throughout the treatment, e.g., to a temperature of 150°–200° F. (65°–95° C.), as penetration is better when hot. As in all pressure processes the pressure period is by far the most important factor affecting the amount and depth of impregnation. In practice it is the magnitude and duration of the pressure that governs the absorption of the treating solution by the timber. In the early stages of the pressure period the absorption by the timber is fairly uniform but then it gradually slows down until the absorption is too slow to be readily observed. When this point is reached the timber is said to have been treated to refusal. The rate of absorption varies greatly with different species, and timbers such as beech or Coriscan pine will be completely impregnated in a few minutes while others like Douglas fir, larch or oak heartwood are not completely penetrated even when under pressure for several days.

The "Empty Cell" treatment, using an initial air pressure, is also known as the Rueping Process and is the standard method for the creosoting of transmission poles. It is also used for wood paving blocks, fencing, and building timbers, and may be used with the treatment solution of the invention. The treating schedules aim at obtaining complete penetration of any sapwood present. The Rueping treatment was introduced about 1912 and differs from the full cell method in that the timber is initially subjected to compressed air instead of a vacuum. The cylinder is then filled with the treating solution while maintaining this pressure, and pressure is then increased with a hydraulic pump until the desired amount of treating solution is injected into the timber. The pressure is then released and the air compressed in the interior of the timber is allowed to escape and in so doing expels the excess liquid, leaving the cell walls coated with treating solution. This method of treatment allows a deep impregnation of the timber without a heavy absorption. The compression of the air originally in the wood serves to recover a small amount of the injected treating solution when the pressure is released. A long final vacuum is also used to assist in this.

Before impregnating timber with any wood treating solution it is essential to season it first until at least all the free water has been removed from the cell spaces. This stage of seasoning represents a moisture content of about 25–30%, varying slightly with different species. There are two very good reasons for this: first, it is not possible to inject another liquid into wood containing much water, and second, splits developing as the result of the subsequent drying of the timber would almost certainly expose untreated timber. It is also desirable to carry out all cutting, machining and boring, etc., of the timber before treatment is applied, as all these operations, if carried out after treatment, would expose untreated wood. Where these operations cannot be done until after treatment all exposed untreated timber should be given a liberal application of treating solution, and holes preferably treated with a pressure bolt-hole treater.

In accord with this invention, wood may be colored and preserved simultaneously, or in two separate stages. Without departing from the teachings of this invention the wood may first be treated with the preservative solution and then contacted with the color stabilizing agent. It is also possible to apply the color stablizing agent to the wood initially, followed by the application of the preservative solution.

Here again, however, it is preferred that the application process be carried out using any known conventional vacuum and/or pressure technique.

The following examples will serve to further illustrate the invention.

EXAMPLE #1

Southern yellow pine lumber (2"×6"×4') was initially treated by a Modified Full Cell process using a 1.0% CCA-C solution. The wood was then treated using a Full Cell process with a water solution containing 0.5% ferric ammonium citrate, 0.12% 8-amino-1-naphthol-3,6-disulfonic acid and 0.28% red dye (CI-36). The resulting wood was reddish-brown in color and was also protected against wood destroying organisms. Upon exposure to the elements for two years, the wood maintained a dark brown color, while the control sample containing no ferric ammonium citrate weathered to a light grayish brown.

EXAMPLE #2

Southern yellow pine lumber (2"×6"×4') was initially treated using a Modified Full Cell process with a 1.2% CCA-C solution. The wood was then treated using a Full Cell process with a water solution containing 1.0% ferric citrate, and 0.3% 8-amino-1-naphthol-3,6-disulfonic acid. The resulting wood was brownish in color and was also protected against wood destroying organisms. Upon exposure to the elements for two years, the wood weathered to a dark brown color, while the control sample containing no ferric citrate weathered to a grayish color.

EXAMPLE #3

Western hemlock blocks (½"×2"×6") were treated with a solution containing 1.0% ferric ammonium citrate and 1.5% CCA-C solution. The wood was initially placed under a vacuum of 30" Hg for 30 minutes, followed by the addition of the treating solution. The system was then pressurized for 30 minutes at a pressure of 110 psi. The resulting wood when dried was a tannish color and was also protected against wood destroying organisms. Upon exposure to the elements for one year, the wood weathered to a brown color.

EXAMPLE #4

Southern yellow pine blocks (½"×2"×6") were treated with a solution containing 1.5% ferric ammonium citrate by the Full Cell Process. Upon exposure to the elements, the wood weathered to a light brown color within one month, and maintained this color for over a year.

EXAMPLE #5

Douglas-fir lumber (2"×6"×4') was simultaneously colored and preserved by the Full Cell Process using a 1.5% CCA-C solution containing 1.0% ferric ammonium citrate and 0.4% red dye (CI-292). The wood was initially placed under a vacuum of 30" Hg for 30 minutes, followed by the addition of the treating solution. The system was pressurized for 30 minutes with a pressure of 140 psi. The resulting wood when dried was reddish-brown in color and was also protected against wood destroying organisms. Upon exposure to the elements for two years, the wood weathered from a reddish-brown color to a dark brown color, while the control sample containing no ferric ammonium citrate weathered to a grayish color.

EXAMPLE #6

Southern yellow pine (2"×6"×4') was simultaneously colored and preserved by the full cell treatment with a 1.2% CCA-C solution containing 0.14% colorant and 0.75% ferric ammonium citrate. The wood was initially placed under a 30" Hg vacuum for 30 minutes, followed by the addition of the treating solution. The system was then pressurized to 110 psi for 30 minutes. The resulting wood was reddish brown in color and was also protected against wood destroying organisms. After two years of exposure to the elements, the wood maintained a brown color.

EXAMPLE #7

Douglas-fir (1½"×2"×6") was initially treated by a modified full cell process using a 1.8% CCA-C treating solution. The wood was then treated with a solution containing 0.25% colorant and 1.75% ferric ammonium citrate using the Full Cell Process. The resulting wood was brownish in color and was also protected against wood destroying organisms. Upon exposure to the elements for two years, the wood maintained a brown color.

EXAMPLE #8

Southern yellow pine blocks (1½"×2"×6") were simultaneously colored and preserved by the full cell treatment with a solution containing 0.25% colorant and 0.75% ferric ammonium citrate in a 1.2% CCA-C solution. The wood was initially placed under a 30" Hg vacuum for 30 minutes, followed by the addition of the treating solution. The system was then pressurized to 115 psi for 45 minutes. The resulting wood, when dried, was colored brown and was also protected against wood destroying organisms. After two years of exposure to the elements, the wood maintained a brown color.

EXAMPLE #9

Southern yellow pine blocks (1½"×2"×6") were initially treated by a Modified Full Cell Process using 1.0% CCA treating solution. The wood was then treated with a solution containing 0.35% colorant and 1.2% ferric formate using the Full Cell Process. The resulting wood was brownish in color and was also protected against wood destroying organisms. Upon exposure to the elements for two years, the wood maintained a brown color.

EXAMPLE #10

Douglas-fir blocks (1½"×2"×6") were initially treated by a Modified Full Cell Process using a 1.5% ammoniacal copper zinc arsenate treating solution. The wood was then treated with a solution containing 0.25% colorant and 1.60% ferric ammonium citrate using the Full Cell Process. The resulting wood when dried was brownish in color and was also protected against wood destroying organisms. Upon exposure to the elements for two years, the wood maintained a brownish color.

EXAMPLE #11

Southern yellow pine lumber (2"×6"×4') was initially treated by a Modified Full Cell Process using a 1.5% ammoniacal copper citrate treating solution. The wood was then treated with a Full Cell Process with a water solution containing 0.10% ferric ammonium oxalate and 0.75% colorant. The resulting wood was reddish-brown in color and was also protected against wood destroying organisms. Upon exposure to the elements for two years, the wood maintained a brown color, while the control sample, containing no ferric ammonium oxalate, weathered to a light grayish color.

In addition, various known additives may be combined with the preservative compositions containing the color stabilizing compounds of the instant invention without adversely affecting long term weathering capability. Additional coloring agents, waxes, resins, aqueous solutions, various emulsions and other ingredients may be added to the treating solution where such additional properties are desirable.

A wide variety of woods can be colored in accordance with this invention including hard and/or softwoods. Many other types of cellulose based materials including paper, particle board, textiles, rope and other such well known cellulose by-products may also be colored in accord with this invention, provided the material is capable of withstanding the treatment process. For this purpose the treatment solution would most likely be applied by spraying, but these solutions may be applied by any method commonly known.

It is fully understood that all of the foregoing Examples are intended to be merely illustrative and not to be construed or interpreted as being restrictive or otherwise limiting of the present invention, excepting as set forth and defined in the hereto appended claims.

What is claimed is:

1. A process for coloring wood which comprises contacting the wood with an aqueous solution containing 0.01%14 10% of an iron salt derived from a mono-, di-, or tri-carboxylic acid or mono-, di-, or tri-carboxylic hydroxy acid containing 1–6 carbon atoms.

2. The process of claim 1 wherein said acid is selected from the group consisting of formic, acetic, glycolic, lactic, hydroxybutyric, glyceric, malic, tartaric, citric, oxalic, malonic, succinic, glutaric and adipic.

3. The process of claim 1 wherein the iron salt is selected from the group consisting of ferric ammonium citrate, ferrous ammonium citrate, ferric ammonium oxalate, ferrous ammonium oxalate, ferric citrate, ferrous citrate, ferric oxalate and ferrous oxalate.

4. An article made of wood colored in accordance with the process of claim 3.

5. Lumber or other cellulose based building materials colored in accordance with the process of claim 3.

6. In a process for preserving wood against wood destroying organisms comprising contacting the wood with an aqueous solution of a known preservative composition containing one or more heavy metals selected from the group consisting of copper, chromium, arsenic and zinc, the improvement comprising further contacting the wood with a solution of an iron salt derived from a mono-, di-, or tri-carboxylic acid or mono-, di-, or tri-carboxylic hydroxy acid containing 1–6 carbon atoms.

7. The process of claim 6 wherein said acid is selected from the group consisting of formic, acetic, glycolic, lactic, hydroxybutric, glyceric, malic, tartaric, citric, oxalic, malonic, succinic, glutaric and adipic.

8. The process of claim 7 wherein said salt is selected from the group consisting of ferric ammonium citrate, ferrous ammonium citrate, ferric ammonium oxalate, ferrous ammonium oxalate, ferric citrate, ferrous citrate, ferric oxalate and ferrous oxalate.

9. The process of claim 8 wherein the concentration of iron salt added to the preservative solution is between 0.01%–10% by weight.

10. The process of claim 9 wherein said salt is added directly to the preservative solution before contacting the wood.

11. The process of claim 9 wherein the wood is first contacted with said salt solution and then contacted with the preservative solution.

12. The process of claim 9 wherein the wood is first contacted with the preservative solution and then contacted with said salt solution.

13. The process of claim 9 wherein the preservative is a Chromated Copper Arsenate solution selected from the group consisting of Type A containing from 16.0%–20.9% copper as copper oxide, about 59.4%–69.3% chromium as chromic acid and about 14.7%–19.7% arsenic as arsenic pentoxide; Type B containing from 18.0%–22.0% copper as copper oxide, about 33.0%–38.0% chromium as chromic acid and about 42.0%–48.0% arsenic as arsenic pentoxide; and Type C containing from 17.0%–21.0% copper as copper oxide, about 44.5%–50.5% chromium as chromic acid and about 30%–38% arsenic as arsenic pentoxide, and the salt solution is an aqueous solution of ferric ammonium citrate.

14. The process of claim 13 wherein the ferric ammonium citrate solution is combined with other known color forming agents or dyes.

15. The process of claim 14 wherein the wood is first treated with the Chromated Copper Arsenate solution, and thereafter treated with the ferric ammonium citrate solution.

16. An article of wood colored in accordance with the process of claim 9.

17. Lumber or other cellulose based building materials colored in accordance with the process of claim 9.

18. A color forming and stabilizing additive for wood and wood products comprising an aqueous solution of an iron salt derived from a mono-, di-, or tri-carboxylic acid or mono-, di-, or tri-carboxylic hydroxy acid containing 1-6 carbon atoms wherein the concentration of iron salt is between 0.01%-10% by weight.

19. The additive of claim 18 wherein said acid is selected from the group consisting of formic, acetic, glycolic, lactic, hydroxybutric, glyceric, malic, tartaric, citric, oxalic, malonic, succinic, glutaric and adipic.

20. The additive of claim 19 wherein said iron salt is selected from th group consisting of ferric ammonium citrate, ferrous ammonium citrate, ferric ammonium oxalate, ferrous ammonium oxalate, ferric citrate, ferrous citrate, ferric oxalate and ferrous oxalate.

21. The additive of claim 20 used in combination with a known wood preservative composition containing one or more heavy metals selected from the group consisting of copper, chromium, arsenic and zinc.

22. The additive of claim 21 used in combination with other known color forming agents or dyes.

* * * * *

UNITED STATES PATENT AND TRADEMARK OFFICE

CERTIFICATE OF CORRECTION

PATENT NO. : 4,752,297

DATED : June 21, 1988

INVENTOR(S) : Robert M. Leach

It is certified that error appears in the above-identified patent and that said Letters Patent are hereby corrected as shown below:

In Claim 1, line 3, change "14" to -- - --.

Signed and Sealed this

First Day of November, 1988

*Attest:*

DONALD J. QUIGG

*Attesting Officer*

*Commissioner of Patents and Trademarks*